US005290623A

United States Patent [19]

Kawahito et al.

[11] Patent Number: 5,290,623

[45] Date of Patent: * Mar. 1, 1994

[54] THERMAL TRANSFER RECORDING MEDIUM

[75] Inventors: Shiro Kawahito; Koichi Sakai, both of Tochigi, Japan

[73] Assignee: KAO Corporation, Tokyo, Japan

[ * ] Notice: The portion of the term of this patent subsequent to Jan. 12, 2010 has been disclaimed.

[21] Appl. No.: 801,469

[22] Filed: Dec. 2, 1991

[30] Foreign Application Priority Data

Dec. 14, 1990 [JP] Japan ..... 402299

[51] Int. Cl.[5] ..... B41M 5/38

[52] U.S. Cl. ..... 428/195; 428/204; 428/422.8; 428/423.1; 428/446; 428/451; 428/473.5; 428/484; 428/488.1; 428/488.4; 428/500; 428/688; 428/913; 428/914

[58] Field of Search ..... 428/195, 423.1, 206, 428/422.8, 447, 484, 500, 488.4, 913, 446, 914, 688, 481, 451, 473.5, 488.1, 423.1, 480, 204

[56] References Cited

U.S. PATENT DOCUMENTS

| | | | |
|---|---|---|---|
| 4,707,406 | 11/1987 | Inaba et al. | 428/195 |
| 4,738,950 | 4/1988 | Vanier et al. | 503/227 |
| 4,910,087 | 3/1990 | Torii et al. | 428/423.1 |
| 4,961,997 | 10/1990 | Asano et al. | 428/195 |
| 5,178,930 | 1/1993 | Sakai et al. | 428/195 |

FOREIGN PATENT DOCUMENTS

| | | |
|---|---|---|
| 0142867 | 5/1985 | European Pat. Off. . |
| 0228294 | 7/1987 | European Pat. Off. . |

OTHER PUBLICATIONS

CA 108(8) 58071P, Shirato, Water Resistant Aqueous Inks.

CA 93(16), 151881 J, Kojima, Acrylic Polymer Water Resistant Ink.

*Primary Examiner*—Patrick J. Ryan

*Assistant Examiner*—William A. Krynski

*Attorney, Agent, or Firm*—Birch, Stewart, Kolasch & Birch

[57] ABSTRACT

A thermal transfer recording medium comprising a substrate and a hot-melt ink layer, provided on one surface of the substrate, and a back-coated layer, provided on the other surface of the substrate, said hot-melt ink layer comprising a polyether resin having a basic bisphenol structure and hydroxyl groups at the terminal ends thereof as a binder, and a colorant, said back-coated layer comprising a reaction product of a polyisocyanate and an amino-modified silicone oil, is disclosed.

The thermal transfer recording medium of the present invention is capable of forming a transferred image of high quality substantially without being affected by the surface properties of the image receiving paper, and has a high stability.

41 Claims, No Drawings

THERMAL TRANSFER RECORDING MEDIUM

FIELD OF THE INVENTION

The present invention relates to a thermal transfer recording medium used in a thermal transfer recording apparatus such as a printer or facsimile. In particular the present invention relates to a thermal transfer recording medium with which a transfer recording with a high image quality can be effected without being affected by the surface properties of an image receiving paper.

DESCRIPTION OF THE RELATED ART

The thermal transfer recording method comprises using a thermal transfer recording medium comprising at least one hot-melt ink layer formed on a sheetlike base material, super imposing the recording medium on an image receiving paper so that the hot-melt ink layer is brought into contact with the paper, and heat melting the ink layer with a heating head from the base material side of the medium. This method is widely employed, since the apparatus used is quiet and has excellent operability and maintainability, and plain paper can be used as the image receiving paper.

As the field of application of printers is widened in the thermal transfer system, new demands which have not been made heretofore arise. The main demands are printing on rough-surface paper and high-speed printing. To meet these demands, the ink and also the printer per se have been widely improved. Particularly remarkable improvements include:

1) a changeover of the thermal head to a projection-shaped one,
2) an increase in the pressure to be applied to the platen (thermal head pressing pressure), and
3) an increase in the printing energy.

As a result, printing conditions have become more critical and the print quality has been remarkably improved. However, on the other hand, a serious problem has been newly posed to improve the thermal resistance of the base film (mainly PET film) and the thermal transfer ink sheet, namely the base film having a back-coated layer.

It was proposed in Japanese Patent Laid-Open No. 7467/1980 to solve the problem by using silicone resin, epoxy resin, phenol resin, fluororesin, polyimide resin, nitrocellulose resin, etc., as a component of the back-coated layer. However, these resins provide insufficient thermal resistance and travelling properties. It was also found that they seriously stained the thermal head.

When a liquid oil such as silicone oil, mineral oil, vegetable oil or synthetic oil is used as a component of the back-coated layer as described in Japanese Patent Laid-Open No. 148697/1984, the liquid oil migrates into the ink side with the time, so that the travelling properties are seriously deteriorated after storage over a long period of time.

Under these circumstances, Japanese Patent Laid-Open No. 137693/1985 proposed the combined use of a heat-resistant resin such as polyvinylidene chloride resin, polyvinyl butyral resin, nitrocellulose resin or the like with a silicone wax as a lubricant in the back-coated layer. However, the thermal resistance and travelling properties were yet insufficient and the prevention of staining of the thermal head was also insufficient. Thus no satisfactory heat-resistant film for the thermal transfer ink sheets has been developed as yet.

The binder contained in the conventional hot-melt ink mainly comprises wax, which causes, when softened, the molten ink to be transferred onto the surface of the image receiving paper, so that the ink is liable to be affected by the paper surface properties. Namely, since the reduction in the viscosity of the wax by heat is significant and the melt viscosity of the ink is quite low, the contact area of the ink with depressed portions of the paper is reduced when the surface of the paper is rough. For example, when the Bekk smoothness of the paper is 30 to 40 seconds or shorter, the spread of the ink becomes nonuniform, reducing the quality of the image.

When the thickness of the ink layer is increased in order to transfer a larger amount of the ink to one dot, the ink should cover the surface of the paper to solve the problem of a reduction in the recording density or the formation of thin spots due to insufficient transfer of the ink. However, on the other hand, bleeding is enhanced to increase the size of each dot and to reduce the resolution, thereby reducing the quality of the image.

As for the techniques in which a resin is used as a binder for the hot-melt ink, those disclosed in Japanese Patent Laid-Open Nos. 87234/1979, 163044/1979, 98269/1981 and 130087/1987 are known, but their performance is not satisfactory.

SUMMARY OF THE INVENTION

Therefore, an object of the present invention is to provide a thermal transfer recording medium capable of forming a transferred image of a high quality without being substantially affected by the surface properties of the image receiving paper. Another object of the present invention is to provide a thermal transfer recording medium having high resolution.

After intensive investigations, the present inventors have confirmed that the above-described objects can be attained by using a backcoating material containing a reaction product of a polyisocyanate and an amino-modified silicone oil for the thermal transfer recording medium and replacing the conventional binder of the hot-melt ink which mainly comprised wax by a polyether resin having a bisphenol skeleton and hydroxyl groups at the ends of the molecule. The inventors have also found that a transferred image having a higher quality can be obtained with a higher sensitivity by providing a release layer between the base material, i.e., the base film and the hot-melt ink layer containing the above-described polyether resin as the binder. The present invention has been completed on the basis of these findings.

Thus the present invention provides a thermal transfer recording medium comprising a substrate, a hot-melt ink layer, provided on one surface of the substrate, and a back-coated layer, provided on the other surface of the substrate, said hot-melt ink layer comprising a polyether resin having a basic structure of bisphenol and hydroxyl groups at the terminals as a binder, and a colorant, said back-coated layer comprising a reaction product of a polyisocyanate and an amino-modified silicone oil.

The hot-melt ink layer of the thermal transfer recording medium preferably comprises 30 to 100% (v/v) of said polyether resin and 70 to 0% (v/v) of a binder component other than said polyether resin based on the whole of the binder.

The hot-melt ink layer of the thermal transfer recording medium further preferably comprises 70 to 100%

(v/v) of said polyether resin and 30 to 0% (v/v) of a binder component other than said polyether resin based on the whole of the binder.

Ethylene-vinylacetate copolymer is preferable as the binder component.

A thermal transfer recording medium having a release layer between said substrate and said hot-melt ink layer is preferable.

The back-coated layer of the thermal transfer recording medium preferably comprises at least one component selected from the group consisting of a heat-resistant component other than said reaction product, a lubricating component other than said reaction product and a pigment.

The back-coated layer of the thermal transfer recording medium preferably comprises an acryl-silicone graft copolymer.

DETAILED DESCRIPTION OF THE INVENTION

The amino-modified silicone oil to be used in the present invention may be any of silicone oils having an amino group in the molecule or containing a compound having an amino group. Examples of them include dimethylpolysiloxane having an amino group or an organic group having an amino group introduced into a part of the methyl groups thereof. Examples of the structures of them are as follows:

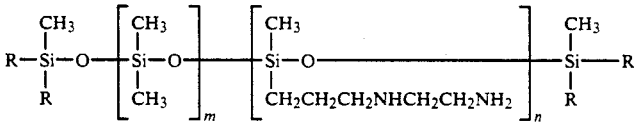

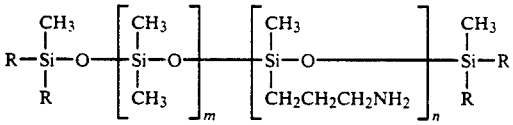

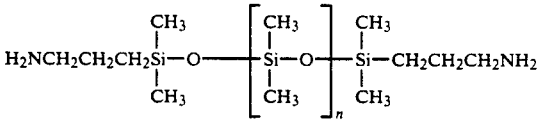

wherein R represents $-CH_3$ or $-OCH_3$ and n and m each represent an integer of at least 1.

The amino-modified silicone oil according to the present invention includes also those into which an amino group is secondarily introduced by using a functional group of a silicone oil modified with a group other than an amino group, such as alcohol-modified silicone oil, carboxyl-modified silicone oil and epoxy-modified silicone oil. A possible example of the process for producing an amino-containing silicone oil from a silicone oil modified with a group other than an amino group is as follows:

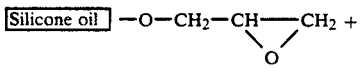

(epoxy-modified silicone oil)

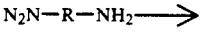

-continued

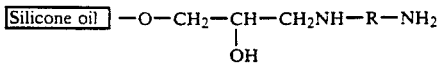

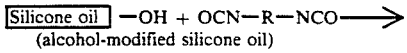

(alcohol-modified silicone oil)

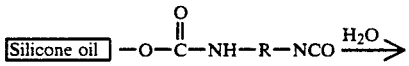

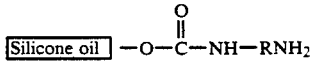

wherein R represents an alkylene or arylene group.

The above-described silicone compounds having a reactive organic functional group are examples of preferred silicone compounds usable in the present invention, which by no means limit the present invention, and any silicone oil having an amino group can be used in the present invention. A mixture of two or more amino-modified silicone oils can also be used as a matter of course.

Examples of the polyisocyanates according to the present invention include aliphatic and aromatic diisocyanates such as 1,5-naphthylene diisocyanate, 4,4'-diphenylmethane diisocyanate, 4,4'-diphenyldimethylmethane diisocyanate, dialkyldiphenylmethane diisocyanate, tetraalkyldiphenylmethane diisocyanate, 4,4'-dibenzyl diisocyanate, 1,3-phenylene diisocyanate, 1,4-phenylene diisocyanate, tolylene diisocyanate, chlorinated isocyanates, brominated isocyanates, phosphorus-containing isocyanates, butane-1,4-diisocyanate, hexane-1,6-diisocyanate, dicyclohexylmethane diisocyanate, cyclohexane-1,4-diisocyanate, xylylene diisocyanate and isophrone diisocyanate.

The polyisocyanates further include adducts of these diisocyanates with other compounds such as those having the following structural formulas, which by no means limit the present invention.

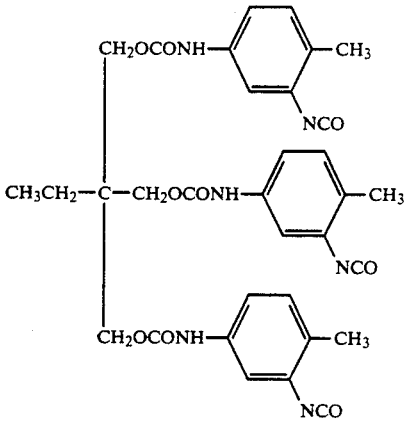

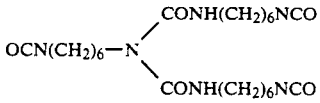

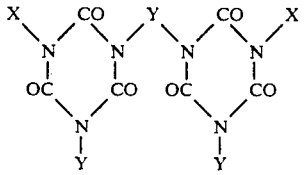

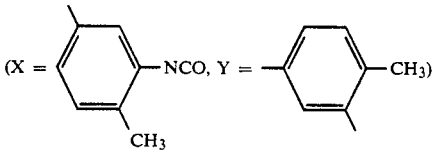

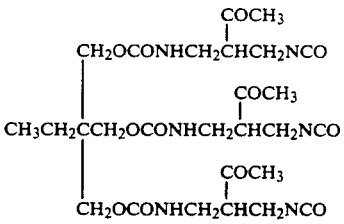

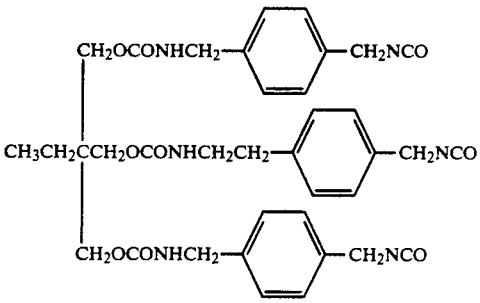

-continued

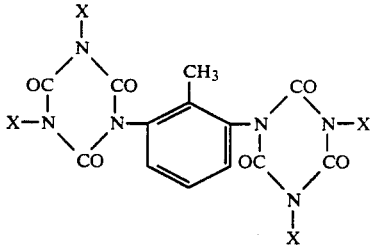

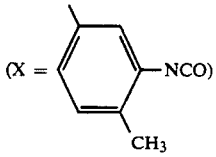

The ratio of the polyisocyanate to the amino-modified silicone oil when they are reacted is preferably in the following range:

$$\frac{\text{amount (g) of polyisocyanate}}{\text{isocyanate equivalent of polyisocyanate*}} \Big/ \frac{\text{amount (g) of amino-modified silicone oil}}{\text{amino equivalent of amino-modified silicone oil**}} > \frac{4}{1}$$

*isocyanateequivalent: average molecular weight having one equivalent of isocynate group or average, molecular weight per one isocyanate group

**amino equivalent: averagemolecular weight having one equivalent of amino group or average molecular weight per one amino group When the amount of the polyisocyanate used is below the range of the formula given above, a gel is inclined to be formed in the course of the incorporation thereof, making the coating work practically impossible.

Excess isocyanate groups may be left as is or, alternatively, a part or the whole thereof may be reacted with water, an amine or an alcohol to deactivate them.

The amount of the backcoating material to be used in the present invention, that is the thickness of the back-coated layer is suitably 0.05 to 2.0 g/m$^2$ (on dry basis). When the amount is below this range, the function of the composition as the backcoating material or the function of the back-coated layer is insufficient and, on the contrary, when it is above this range, the conduction of heat from the thermal head is inhibited, causing poor ink transfer.

In the present invention, another heat-resistant component (such as silicone resin, epoxy resin, nitrocellulose resin, silicone-modified acrylic resin, polyimide resin, vinyl chloride/vinyl acetate resin and urethane resin) or another lubricating component (such as silicone oil, fine silica powder, alkyl phosphate and fluorine compound) can be used with the above-described reaction product of the amino-modified silicone oil and the polyisocyanate in the backcoating material depending on the purpose. It is also possible to add a pigment such as carbon black to the backcoating material for imparting antistatic properties or for the security of confidential information.

The substrate or the base material of the thermal transfer recording medium of the present invention is desirably a film having high thermal resistance, dimensional stability and surface smoothness. Examples thereof include a PET (polyethylene terephthalate) film and films of other resins, such as polycarbonate, polyethylene, polystyrene, polypropylene and polyimide, having a thickness of 2 to 2 μm.

The polyether resin having a bisphenol skeleton and hydroxyl groups at the ends of the molecule or at terminals which is an indispensable component of the hot-melt ink in the thermal transfer recording medium of the present invention is generally one which has a number-average molecular weight (in terms of polystyrene) determined by gel permeation chromatography (GPC) of about 20,000 or below and a glass transition point (Tg) determined by the differential thermobalance method (DSC) of 40° C. or above, still preferably a number-average molecular weight of about 10,000 or below and Tg in the range of about 55° to 90° C. When the Tg is below 55° C., particularly below 40° C., the hot-melt ink is apt to cause blocking, and the stability during storage or at the time of use is poor. When the Tg is above 90° C., the sensitivity is reduced, impairing the serviceability thereof, and limiting the use thereof, though the thermal stability is excellent.

It was experimentally found that the sensitivity was reduced when the molecular weight of the polyether resin was high, even though the Tg was in the above-described range. This is supposedly due to an intermolecular cohesive force generated by the entanglement of the molecular chains. Excellent transferring and fixing properties were obtained when the number-average molecular weight of the polyether resin was about 20,000 or less, particularly about 10,000 or less. It was also found that no influence was exerted by the surface properties of the image receiving paper. The limitation of the weight-average molecular weight of the polyether resin varies depending on the use of the thermal transfer recording medium. When a two-valued transferred image is to be formed by using the ink according to the present invention as same as by using a conventional ink containing a wax, it is desirable to regulate the weight-average molecular weight of the polyether resin used to about 20,000 or less, preferably about 10,000 or less, and to make the softening properties of the resin more sensitive by narrowing the molecular weight distribution. On the contrary, when a density gradation or the formation of a multivalued transferred image is intended, or when the recording medium is to be repeatedly used many times, it is desirable to melt-transfer a resin having mild softening properties depending on the applied energy. For this purpose, it is not always necessary to reduce the weight-average molecular weight of the polyether resin, and it may be above about 20,000. An excellent two-valued transferred image can also be obtained in such a case as a matter of fact. As for the shape of the molecular weight distribution, it is not always limited to one with a single molecular weight peak, but it may be one with two or more molecular weight peaks. Crosslinked and branched polymer components can also be used together with the above polyether resin. However, a weight-average molecular weight of 10,000 or above, particularly 40,000 or above, is disadvantageous from the viewpoint of sensitivity.

The polyether resin having a bisphenol skeleton and hydroxyl groups at the ends of the molecule to be used in the present invention includes those obtained by the addition polymerization of a diol such as bisphenol compounds of the following formulae:

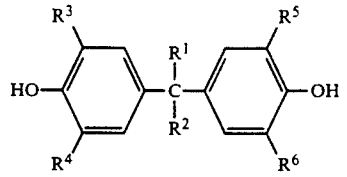

1)

wherein $R^1$ and $R^2$ each represent a hydrogen atom, an alkyl group or a phenyl group, and $R^3$, $R^4$, $R^5$ and $R^6$ each represent a hydrogen atom, a halogen atom or an alkyl group,

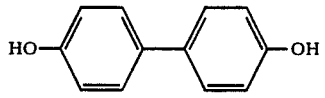

2)

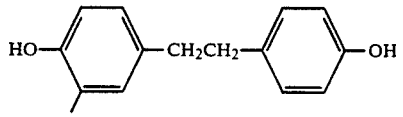

3)

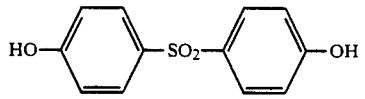

4)

a propylene oxide adduct thereof and an ethylene oxide adduct thereof with an aliphatic, alicyclic or aromatic epoxy compound having two epoxy groups in the molecule in such a manner that no epoxy group will remain at the end of the molecule; and those obtained by the addition polymerization of a bisphenol-type epoxy resin with a compound having two hydroxyl groups, a combination of a hydroxyl group and an amino group or a combination of a hydroxyl group and a carbonyl group in the molecule in such a manner that no epoxy group will remain at the end of the molecule. Further a branched or crosslinked polyether resin produced from an epoxy compound having three or more epoxy groups in the molecule may also be used. Processes for producing the polyether resins used in the present invention are not limited to above, as a matter of course.

Although the object of the present invention can be fully attained with the binder material of the hot-melt ink comprising only one or more polyether resins as described above, other polymers and additives may also be added thereto to form a mixture, if necessary.

Examples of the polymers usable herein include homopolymers and copolymers of styrene, its derivatives and substituted styrenes such as styrene, vinyltoluene, α-methylstyrene, 2-methylstyrene, chlorostyrene, vinylbenzoic acid, sodium vinylbenzenesulfonate and aminostyrene; homopolymers of vinyl monomers such as methacrylates, e.g., methyl methacrylate, ethyl methacrylate, butyl methacrylate and hydroxyethyl methacrylate and methacrylic acid; acrylates, e.g., methyl acrylate, ethyl acrylate, butyl acrylate and 2-ethylhexyl acrylate and acrylic acid; dienes, e.g., butadiene and isoprene; acrylonitrile, vinyl ethers, maleic acid, maleates, maleic anhydride, cinnamic acid and vinyl chloride, and copolymers of the above-described vinyl monomers with another monomer. As a matter of course, the resin made of the above-described vinyl monomers may be a crosslinked polymer formed with a polyfunctional monomer such as divinylbenzene. Further, polycarbonates, polyamides, polyesters, polyurethanes, silicone resins, fluororesins, phenol resins, terpene resins, petroleum resins, hydrogenated petroleum resins, alkyd resins, ketone resins and cellulose derivatives may also be used. When these polymers or oligomers are used in the form of a copolymer thereof, the copolymers may be suitably selected from among random copolymers as well as alternating copolymers, graft copolymers, block copolymers and interpenetrating copolymers depending on the use thereof. When a mixture of two or more polymers and/or oligomers is used, the mixture can be formed by a mechanical mixing method such as melt mixing, solution mixing or emulsion mixing or by coexistence polymerization or multistage polymerization for polymerizing the starting components for the polymer or oligomer.

If necessary, wax, oil and liquid plasticizer which are incorporated into ordinary hot-melt inks can be mixed therein. The amount of the polyether resin component is generally at least 30% (v/v) based on whole of the binder materials, and preferably at least 70% (v/v) based on whole of the binder materials from the viewpoint of the quality of the image.

The colorants usable in the hot-melt ink of the present invention include black dyes and pigments such as carbon black, oil black and graphite; monoazo yellow pigments (Fast Yellow) comprising an acetoacetic arylamide, such as C. I. Pigment Yellow 1, 3, 74, 97 and 98; bisazo yellow pigments comprising an acetacetic arylamide, such as C. I. Pigment Yellow 12, 13 and 14; yellow dyes such as C. I. Solvent Yellow 19, 77 and 79 and C. I. Disperse Yellow 164; red or crimson pigments such as C. I. Pigment Red 48, 49:1, 53:1, 57:1, 81, 122 and 5; red dyes such as C. I. Solvent Red 52, 58 and 8; and blue dyes and pigments such as copper phthalocyanines, e.g., C. I. Pigment blue 15:3 and derivatives thereof and modified products thereof. Further dyes and pigments known in the field of the printing ink and other coloring fields, such as colored or colorless subliming dyes, are also usable.

These dyes and pigments can be used either singly or in the form of a mixture of two or more of them. As a matter of course, the color tone can be controlled by mixing them with an extender pigment or white pigment. The surface of the colorant can be treated with a surfactant, a coupling agent such as a silane coupling agent, or a polymeric material in order to improve the dispersibility in the binder material, or a polymeric dye or polymeric graft pigment can be used.

The thermal transfer recording medium of the present invention can be formed by applying the hot-melt ink comprising a mixture of the above-described polyether resin and pigment and, if necessary, the above-described additives, on the substrate or the base material. By forming a release layer between the substrate and the hot-melt ink layer, the thermal transfer recording medium exhibits improved sensitivity.

The release layer comprises a silicone resin, a higher fatty acid, a metal salt of a higher fatty acid, a fatty acid derivative, a higher alcohol or a wax. A wax is particularly preferred and includes known-waxes used heretofore, such as paraffin wax, montan wax, carnauba wax, beeswax, Japan wax, and candelilla wax as well as low-molecular weight polyethylenes and α-olefin oligomers and modified products of them. These waxes may be used either singly or in the form of a mixture of two or more of them. In addition to the wax, a resin such as ethylene/vinyl acetate copolymer, ethylene/acrylic acid copolymer, polyethylene or petroleum resin can be added in order to improve the strength of the coating film, i.e., the release layer.

The hot-melt ink according to the present invention can be prepared by dissolving or dispersing the binder material in a solvent or dispersion medium in which it can be stably dissolved or dispersed to form a solution or dispersion emulsion, which is processed in a mixing or dispersing apparatus such as a ball mill, sand mill, attritor, basket mill or triple-roll mill. Alternatively, the binder material may be melt-mixed without particularly using any solvent in a heating tripe-roll mill, heating kneader, heating sand mill or heating attritor. Further the polyether resin which is the main binder material can be synthesized in the presence of a colorant, additive, etc., to obtain a hot-melt ink.

The hot-melt ink thus prepared is applied to the substrate having a back-coated layer at the back thereof by solution coating or melt coating with a gravure coater, wire bar or the like to obtain a print.

The hot-melt ink may be finely pulverized by spray drying or pulverization and then applied to the substrate by, e.g., electrostatic coating. If necessary, the coated substrate may be further heated, pressed or treated with a solvent to fix the ink on the substrate.

As described above, the thermal transfer recording medium capable of forming a transferred image of a high quality without being affected by the roughness of the surface of the image receiving paper can be obtained according to the present invention. A thermal transfer recording medium capable of forming a transferred image of a far higher sensitivity can be obtained by forming a release layer mainly comprising a wax between the substrate and the hot-melt ink layer of the thermal transfer recording medium of the present invention.

EXAMPLES

The following Examples will further illustrate the present invention, which by no means limit the invention. In the Examples, parts are given by weight unless otherwise stated.

Referential Example 1

A mixture of 60 parts of Coronate L (a polyisocyanate mfd. by Nippon Polyurethane Industry Co. Ltd.) (a reaction product of 1 mol of trimethylolpropane with 3 mol of tolylene diisocyanate; a solution having a solid content of 75% in ethyl acetate) with 280 parts of cyclohexanone was stirred at 25° C. for 10 minutes to obtain a homogeneous solution.

Then a solution of 28 parts of an amino-modified silicone oil (SF 8417) having an amino equivalent of 1800 (mfd. by Toray Silicone Co. Ltd.) in 362 parts of methyl ethyl ketone was added thereto and the mixture was stirred at 25° C. for 1 hour. The isocyanate content of the solution was 1.10%. Then 7.3 parts of water and 0.73 parts of triethylamine were added to the solution and the mixture was stirred at 25° C. for 10 hour.

The resulting backcoating material solution ($S_1$) had a solid content of 9.9% and a solution viscosity at 20° C. of 6 cps. The isocyanate content was 0.001%.

Referential Example 2

A mixture of 100 parts of acryl/silicone graft polymer (X 24-3544 mfd. by Shin-Etsu Chemical Co., Ltd.) (a solution having a solid content of 50% in toluene), 310 parts of methyl ethyl ketone, 152 parts of cyclohexanone and 40 parts of Coronate L was stirred at 25° C. for 10 minutes to obtain a homogeneous solution.

Then a solution of 28 parts of SF 8417 in 450 parts of methyl ethyl ketone was added thereto and the mixture was stirred at 25° C. for 1 hour. The resulting solution of the backcoating material ($S_2$) had an isocyanate content of 0.48%, a solid content of 10.0% and a solution viscosity at 20° C. of 6.8 cps.

Referential Example 3

20 parts of a 10% solution of SF 8417 in methyl ethyl ketone was added to 100 parts of a 10% solution of carboxyl-modified nitrocellulose resin mfd. by Asahi Chemical Industry Co., Ltd. (Cellunova BTK 1/8 having a carboxyl equivalent of 12500) and the resulting solution was stirred.

The resulting backcoating material solution ($S_3$) had a solid content of 9.8% and a solution viscosity at 20° C. of 6.3 cps.

Referential Example 4

Synthesis of polyether resin A 370 g of a bisphenol-type epoxy resin (Epiclon mfd. by Dainippon Ink & Chemicals, Inc.) and 350 g of bisphenol A were placed in a 1-l separable flask and homogeneously melt-mixed at 130° C. in the presence of a catalyst to obtain a polyether resin A having hydroxyl groups in the molecule.

Preparation of hot-melt ink A

The following hot-melt ink components were kneaded in a ball mill at ambient temperature for 24 hours to obtain a hot-melt ink (A):

| | |
|---|---|
| polyether resin A [number-average molecular weight (Mn): 2000, weight-average molecular weight (Mw): 4000, glass transition point (Tg): 65° C.] | 12 parts |
| ethylene/vinyl acetate copolymer | 4 parts |
| carbon black | 4 parts |
| toluene | 40 parts |
| methyl ethyl ketone | 40 parts |

Referential Example 5

The following hot-melt ink components were kneaded in a ball mill at ambient temperature for 24 hours to obtain a hot-melt ink (B):

| | |
|---|---|
| polyether resin B [reaction product of Epikote 828 (mfd. by Yuka Shell Epoxy K.K.) with bisphenol A having: number-average molecular weight (Mn) of 8,000, weight-average molecular weight (Mw) of 15,000, and glass transition point (Tg) of 83° C.] | 14 parts |
| ethylene/vinyl acetate copolymer | 2 parts |
| carbon black | 4 parts |
| toluene | 40 parts |
| methyl ethyl ketone | 40 parts |

Referential Example 6

The following hot-melt ink components were kneaded in a ball mill at ambient temperature for 24 hours to obtain a hot-melt ink (C):

| | |
|---|---|
| polyether resin C | 12 parts |

-continued

| | |
|---|---|
| [reaction product of Denacol EX-201 (mfd. by Nagase Industries Co.) and bisphenol A having: number-average molecular weight (Mn) of 3000, weight-average molecular weight (Mw) of 7000, and glass transition point (Tg) of 75° C.] | |
| ethylene/vinyl acetate copolymer | 2 parts |
| carbon black | 6 parts |
| toluene | 40 parts |
| methyl ethyl ketone | 40 parts |

Referential Example 7

The following hot-melt ink components were kneaded with a triple-roll mill by hot-melt kneading to obtain a hot-melt ink (D):

| | |
|---|---|
| paraffin wax (m.p.: 72° C.) | 50 parts |
| carnauba wax | 20 parts |
| ethylene/vinyl acetate copolymer | 10 parts |
| carbon black | 20 parts |

Referential Example 8

The following hot-melt ink components were kneaded in a ball mill at ambient temperature for 24 hours to obtain a hot-melt ink (E):

| | |
|---|---|
| bisphenol-type epoxy resin [Epikote 1004 mfd. by Shell Chemical Co.; m.p.: 96 to 104° C.] | 12 parts |
| ethylene/vinyl acetate copolymer | 4 parts |
| carbon black | 4 parts |
| toluene | 40 parts |
| methyl ethyl ketone | 40 parts |

Referential Example 9

The following hot-melt ink components were kneaded in a ball mill at ambient temperature for 24 hours to obtain a hot-melt ink (F):

| | |
|---|---|
| parafin wax (m.p.: 72° C.) | 10 parts |
| carnauba wax | 2 parts |
| ethylene/vinyl acetate copolymer | 3 parts |
| carbon black | 5 parts |
| toluene | 40 parts |
| methyl ethyl ketone | 40 parts |

EXAMPLE 1

The backcoating material solution ($S_1$) obtained in the Referential Example 1 was applied to one surface of 3.5 μm (thickness) PET film in a coating weight of 0.4 g/m$^2$ (on dry basis) to obtain a heat-resistant film.

Then the hot-melt ink (A) obtained in the Referential Example 4 was applied to the other surface (backcoating-free surface) of the heat-resistant film in a coating weight of 3 g/m$^2$ (on dry basis) to form an ink sheet as the thermal transfer recording medium.

EXAMPLE 2

An ink sheet was prepared in a similar manner to that of the Example 1 except that the backcoating material solution ($S_1$) was replaced by the backcoating material ($S_2$) obtained in the Referential Example 2.

EXAMPLE 3

An ink sheet was prepared in a similar manner to that of the Example 1 except that the hot-melt ink (A) was replaced by the hot-melt ink (B) obtained in the Referential Example 5.

EXAMPLE 4

An ink sheet was prepared in a similar manner to that of the Example 1 except that the hot-melt ink (A) was replaced by the hot-melt ink (C) obtained in the Referential Example 6.

Comparative Example 1

An ink sheet was prepared in a similar manner to that of the Example 1 except that the backcoating material solution ($S_1$) was replaced by the backcoating material ($S_3$) obtained in the Referential Example 3.

EXAMPLE 5

The backcoating material solution ($S_1$) obtained in the Referential Example 1 was applied to one surface of a 3.5 μm (thickness) PET film in a coating weight of 0.4 g/m$^2$ (on dry basis) to obtain a heat-resistant film.

Then the following layers were formed on the other surface (backcoating-free surface) of the heat-resistant film to form an ink sheet as the thermal transfer recording medium.

(1) Release layer:

Microcrystalline was (m.p.: 75° C.) was applied with a wire bar in a thermostated bath at 100° C. to form a release layer having a thickness of 1.5 μm.

(2) Hot-melt ink layer:

The hot-melt ink (A) obtained in the Referential Example 4 was applied on the release layer with a wire bar to form a hot-melt ink layer having a thickness of 2 μm, thereby forging a thermal transfer ink sheet.

EXAMPLE 6

An ink sheet was prepared in a similar manner to that of the Example 5 except that the backcoating material solution ($S_1$) was replaced by the backcoating material ($S_2$) obtained in the Referential Example 2.

EXAMPLE 7

An ink sheet was prepared in a similar manner to that of the Example 5 except that carnauba wax (melting point: 85° C.) was used for preparing the release layer.

EXAMPLE 8

An ink sheet was prepared in a similar manner to that of the Example 5 except that oxidized paraffin wax (melting point: 85° C.) was used for preparing the release layer.

Comparative Example 2

An ink sheet was prepared in a similar manner to that of the Example 1 except that the hot-melt ink (A) was replaced by the hot-melt ink (D) obtained in the Referential Example 7 and the hot-melt ink was applied to the film on a hot plate heated to 110° C.

Comparative Example 3

An ink sheet was prepared in a similar manner to that of the Example 1 except that the hot-melt ink (A) was replaced by the hot-melt ink (E) obtained in the Referential Example 8.

Comparative Example 4

An ink sheet was prepared in a similar manner to that of the Example 5 except that the backcoating material solution ($S_1$) was replaced by the backcoating material ($S_3$) obtained in the Referential Example 3.

Comparative Example 5

An ink sheet was prepared in a similar manner to that of the Example 5 except that the hot-melt ink (A) was replaced by the hot-melt ink (F) obtained in the Referential Example 9.

Comparative Example 6

An ink sheet was prepared in a similar manner to that of the Example 5 except that the hot-melt ink (A) was replaced by the hot-melt ink (E) obtained in the Referential Example 8.

Evaluation method

The ink sheets thus obtained were used for printing with a serial printer PC-PR150V mfd. by NEC Corporation and the print density, recording sensitivity, resolution of the transferred image and stability of the ink sheet were examined.

A thermal blocking resistance test was conducted by putting the inked surface of the ink sheet and the back-coated surface of the heat-resistant film (i.e., the ink sheet having no hot-melt ink layer) together, heating the whole at 60° C. under a load of 500 g/cm$^2$ for 10 hours, peeling off the ink sheet from the heat-resistant film, and examining whether the ink of the ink sheet was transferred to the back-coated surface of the heat-resistant film or not.

The results are given in Table 1.

The definite evaluation methods are as follows: Print density: Continuous printed characters were examined with a Macbeth reflection densitometer.

As for the surface properties of the image receiving paper, the Bekk smoothness of a thermal transfer paper was 200 seconds and that of a copying paper was 55 seconds.

Recording sensitivity: The recording sensitivity was determined in terms of an energy (E) to be applied to the thermal head for recording transfer dots corresponding to the size (1/12 mm=83 μm) of a heating element of the thermal head to the thermal transfer paper at the print density of 1.2.

Criteria of evaluation:

○: $E<0.08$ mJ/dot,

Δ: 0.08 mJ/dot $\leqq E \leqq$ 0.11 mJ/dot,

×: 0.11 mJ/dot $<E$, or the print density fails to reach 1.2.

Resolution: The resolution was evaluated on the basis of the decipherability of "kanji" (Chinese characters) (particularly those having a large number of strokes).

Criteria of evaluation:

○: well decipherable

Δ: normal

×: difficulty decipherable

Stability of ink sheet: The ink sheet was stored under conditions comprising a temperature of 45° C. and a humidity of 85% for 24 hours (environmental test) and then subjected to the print evaluation test. The results were compared with those obtained prior to the environmental test.

Criteria of evaluation:

○: the quality of the print unchanged,

×: the quality of the print deteriorated.

Thermal blocking resistance: The inked surface of the ink sheet was put together with the back-coated surface of the heat-resistant film and heated at 60° C. under a load of 500 g/cm$^2$ for 10 hours. Then the ink sheet was peeled from the heat-resistant film.

Criteria of evaluation:

○: the inked surface perfect,

Δ: the ink partly transferred to the back-coated surface of the heat-resistant film, ×: the ink mostly transferred to the back-coated surface of the heat-resistant film.

TABLE 1

| | | Print density | | | Resolution | Stability | Thermal |
|---|---|---|---|---|---|---|---|
| | | Thermal transfer paper | Copying paper | Recording sensitivity | of transferred image | of ink sheet | blocking resistance |
| Ex. No. | 1 | 1.62 | 1.37 | o | o | o | o |
| | 2 | 1.58 | 1.32 | o | o | o | o |
| | 3 | 1.55 | 1.33 | o | o | o | o |
| | 4 | 1.60 | 1.35 | o | o | o | o |
| | 5 | 1.65 | 1.44 | o | o | o | o |
| | 6 | 1.62 | 1.42 | o | o | o | o |
| | 7 | 1.62 | 1.40 | o | o | o | o |
| | 8 | 1.63 | 1.44 | o | o | o | o |
| Comp. Ex. No. | 1 | 1.53 | 1.25 | o | o | o | x |
| | 2 | 1.35 | 0.85 | Δ | x | o | o |
| | 3 | 1.48 | 1.28 | Δ | x | x | x |
| | 4 | 1.60 | 1.39 | o | o | o | x |
| | 5 | 1.43 | 0.92 | o | x | o | o |
| | 6 | 1.52 | 1.34 | Δ | x | x | x |

An addition description will be further made on the results of the evaluation of the hot-melt ink sheet listed in Table 1.

It is apparent from Comparative Examples 1 and 4 having a nitrocellulose-type back-coated layer that the hot-melt ink layer containing the polyether resin as a binder and the nitrocellulose-type back-coated layer were apt to cause blocking.

However, the back-coated layer containing the reaction product of the polyisocyanate and the amino-modified silicone oil and the hot-melt ink layer containing the polyether resin as a binder were quite excellent from the viewpoint of the thermal blocking resistance (refer to Examples 1 through 8).

Although relatively good printing results were obtained with the thermal transfer paper in Comparative Example 2 where the hot-melt ink layer contained waxes as the binder, the print density was low when copying paper having a rough surface was used and the "kanji" Figures (Chinese characters) having many strokes were unclear, making them indecipherable. On the contrary, quite excellent printing results were obtained and a high print density was obtained even with the copying paper in Example 1.

Although a performance close to that of the thermal transfer recording medium of the present invention could be obtained in Comparative Example 3 where the hot-melt ink layer contained the epoxy resin as the binder, the ink sheet had insufficient storability, since the binder resin contained a reactive epoxy group.

In Comparative Examples 5 and 6, the effects obtained by forming the release layer mainly comprising wax between the substrate and the hot-melt ink layer were exhibited. The print quality was superior to that obtained in Comparative Example 2, but inferior to that obtained in each of the Examples.

In Examples 5 to 8, the effects obtained by forming the release layer mainly comprising wax between the substrate and the hot-melt ink layer were exhibited. The print quality was far superior to that obtained in Examples 1 through 4.

We claim:

1. A thermal transfer recording medium, consisting essentially of a substrate, a hot-melt ink layer, and a release layer between said substrate and said hot-melt ink layer, provided on one surface of said substrate, and a back-coated layer, provided on the other surface of said substrate, said hot-melt ink layer comprising a polyether resin having a bisphenol skeleton and hydroxyl groups at the terminal ends thereof as a binder, and a colorant, said release layer comprising a member selected from the group consisting of a silicone resin, a higher fatty acid, a metal salt of a higher fatty acid, a fatty acid derivative, a higher alcohol, and a wax, and said back-coated layer comprising a reaction product of a polyisocyanate and at least one amino-modified silicone oil.

2. The thermal transfer recording medium according to claim 1, wherein said hot-melt ink layer comprises 30 to 100% (v/v) of said polyether resin and 70 to 0% (v/v) of a binder component other than said polyether resin based on the total amount of said binder.

3. The thermal transfer recording medium according to claim 1, wherein said hot-melt ink layer comprises 70 to 100% (v/v) of said polyether resin and 30 to 0% (v/v) of a binder component other than said polyether resin based on the total amount of said binder.

4. The thermal transfer recording medium according to claim 3, wherein said binder component other than said polyether resin is ethylene-vinylacetate copolymer.

5. The thermal transfer recording medium according to claim 1, wherein said back-coated layer further comprises at least one component selected from the group consisting of a heat-resistant component other than said reaction product of a polyisocyanate and at least one amino-modified silicone oil, a lubricating component other than said reaction product of a polyisocyanate and at least one amino-modified silicone oil, and a pigment.

6. The thermal transfer recording medium according to claim 1, wherein said back-coated layer further comprises an acryl-silicone graft copolymer.

7. The thermal transfer recording medium according to claim 1, wherein said amino-modified silicone oil contains an amino group in the molecule.

8. The thermal transfer recording medium according to claim 7, wherein said amino-modified silicone oil is dimethylpolysiloxane containing an amino group or an organic group having an amino group introduced into a part of the methyl groups thereof.

9. The thermal transfer recording medium according to claim 8, wherein said amino-modified silicone oil is a member selected from the group consisting of:

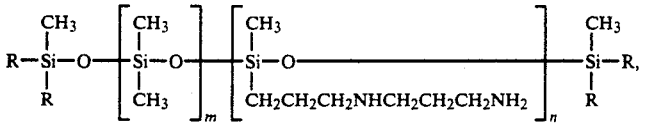

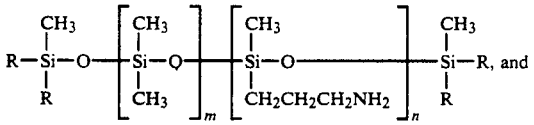

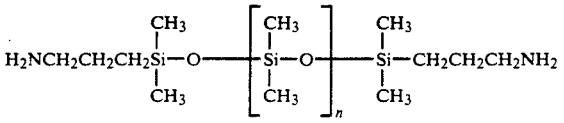

wherein R represents $-CH_3$ or $-OCH_3$ and n and m each represent an integer of at least 1.

10. The thermal transfer recording medium according to claim 1, wherein said amino-modified silicone oil is one into which an amino group is secondarily introduced into a silicone oil modified with a functional group other than an amino group.

11. The thermal transfer recording medium according to claim 10, wherein said silicone oil is an alcohol-modified silicone oil, a carboxyl-modified silicone oil, or an epoxy-modified silicone oil.

12. The thermal transfer recording medium according to claim 1, wherein said polyisocyanate is an aliphatic diisocyanate or an aromatic diisocyanate.

13. The thermal transfer recording medium according to claim 12, wherein said polyisocyanate is a member selected from the group consisting of 1,5-naphthylene diisocyanate, 4,4'-diphenylmethane diisocyanate, 4,4'-diphenyldimethylmethane diisocyante, dialkyldiphenylmethane diisocyanate, tetraalkyl-diphenylmethane diisocyanate, 4,4'-dibenzyl diisocyanate, 1,3-phenylene diisocyanate, 1,4-phenylene diisocyanate, tolylene diisocyanate, a chlorinated isocyanate, a brominated isocyanate, a phosphorus-containing isocyanate, butane-1,4-diisocyanate, hexane-1,6-diisocyanate, dicyclohexylmethane diisocyanate, cyclohexane-1,4-diisocyanate, xylylene diisocyanate and isophrone diisocyanate.

14. The thermal transfer recording medium according to claim 1, wherein said polyisocyanate is an adduct of a compound selected from the group consisting of 1,5-naphthylene diisocyanate, 4,4'-diphenylmethane diisocyanate, 4,4'-diphenyldimethylmethane diisocyanate, dialkyldiphenylmethane diisocyanate, tetraalkyldiphenylmethane diisocyanate, 4,4'-dibenzyl diisocyanate, 1,3-phenylene diisocyanate, 1,4-phenylene diisocyanate, tolylene diisocyanate, a chlorinated isocyanate, a brominated isocyanate, a phosphorus-containing isocyanate, butane-1,4-diisocyanate, hexane-1,6-diisocyanate, dicyclohexylmethane diisocyanate, cyclohexane-1,4-diisocyanate, xylylene diisocyanate and isophrone diisocyanate with a compound selected from the group consisting of

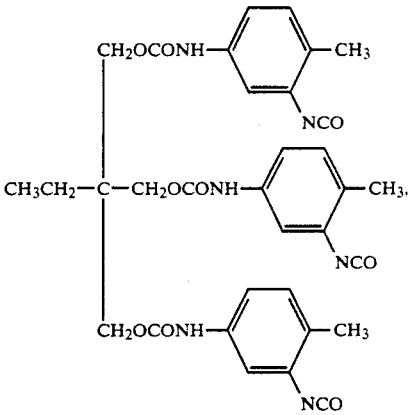

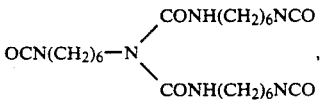

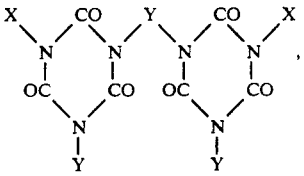

wherein X is 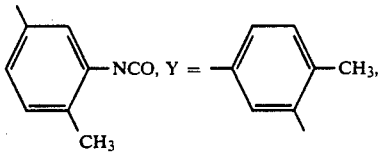

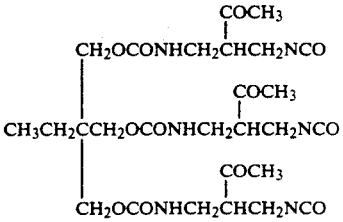

-continued

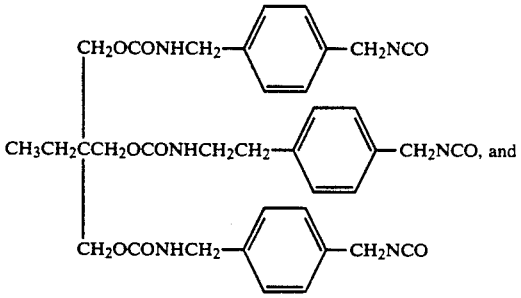

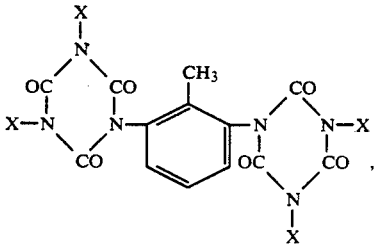

wherein X is 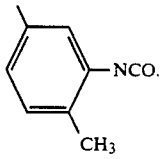

15. The thermal transfer recording medium according to claim 1, wherein said back-coated layer has a thickness of from 0.05 to 2.0 g/m$^2$.

16. The thermal transfer recording medium according to claim 1, wherein said back-coated layer further comprises a heat-resistant component selected from the group consisting of a silicone resin, an epoxy resin, a nitrocellulose resin, a silicone-modified acrylic resin, a polyimide resin, a vinyl chloride/vinyl acetate resin, and a urethane resin.

17. The thermal transfer recording medium according to claim 1, wherein said back-coated layer further comprises a lubricating component selected from the group consisting of a silicone oil, a fine silica powder, an alkyl phosphate, and a fluorine compound.

18. The thermal transfer recording medium according to claim 1, wherein said back-coated layer further comprises a pigment.

19. The thermal transfer recording medium according to claim 1, wherein said substrate is a film possessing high thermal resistance, dimensional stability, and surface smoothness.

20. The thermal transfer recording medium according to claim 19, wherein said substrate is a member selected from the group consisting of a polyethylene terephthalate film, a polycarbonate film, a polyethylene film, a polystyrene film, a polypropylene film, and a polyimide film, wherein said substrate has a thickness of 2 to 20 μm.

21. The thermal transfer recording medium according to claim 1, wherein said polyether resin having a bisphenol skeleton and hydroxyl groups at the terminal ends thereof has a number-average molecular weight in terms of polystyrene determined by gel permeation chromatography of about 20,000 or less and a glass transition point Tg determined by the differential thermobalance method of 40° C. to 90° C.

22. The thermal transfer recording medium according to claim 21, wherein said polyether resin has a number-average molecular weight of about 10,000 or less and a glass transition point in the range of about 55° to 90° C.

23. The thermal transfer recording medium according to claim 1, wherein said polyether resin is produced by the addition polymerization of a diol selected from the group consisting of

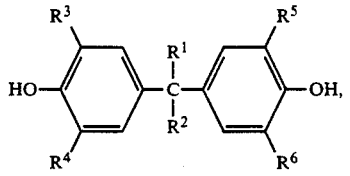

wherein $R^1$ and $R^2$ each represents a hydrogen atom, an alkyl group or a phenyl group, and $R^3$, $R^4$, $R^5$ and $R^6$ each represents a hydrogen atom, a halogen atom or an alkyl group,

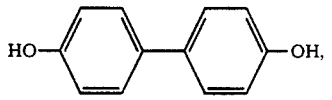

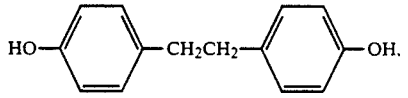

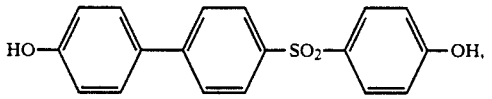

a propylene oxide adduct thereof, and an ethylene oxide adduct thereof with an aliphatic, alicyclic or aromatic epoxy compound having two epoxy groups in the molecule in such a manner that no epoxy group remains at the end of the molecule.

24. The thermal transfer recording medium according to claim 1, wherein said polyether resin is produced by the addition polymerization of a bisphenol-type epoxy resin with a compound having two hydroxyl groups, a combination of a hydroxyl group and an amino group, or a combination of a hydroxyl group and a carbonyl group in the molecule so that no epoxy group remains at the end of the molecule.

25. The thermal transfer recording medium according to claim 24, wherein said polyether resin is a branched or crosslinked polyether resin produced from an epoxy compound having three or more epoxy groups in the molecule.

26. The thermal transfer recording medium according to claim 1, wherein said hot-melt ink layer further comprises a polymer selected from the group consisting of a homopolymer of styrene, a copolymer of styrene, and a derivative of styrene.

27. The thermal transfer recording medium according to claim 26, wherein said polymer is a member selected from the group consisting of styrene, vinyltoluene, α-methylstyrene, 2-methylstyrene, chlorostyrene, vinylbenzoic acid, sodium vinylbenzene-sulfonate and aminostyrene.

28. The thermal transfer recording medium according to claim 1, wherein said hot-melt ink layer further comprises a homopolymer of vinyl monomers.

29. The thermal transfer recording medium according to claim 28, wherein said homopolymer is a member selected from the group consisting of a methacrylate, an acrylate, a diene, acrylonitrile, a vinyl ether, maleic acid, a maleate, maleic anhydride, cinnamic acid, and vinyl chloride.

30. The thermal transfer recording medium according to claim 1, wherein said hot-melt ink layer further comprises 70 to 0% (v/v) of a copolymer of a methacrylate, an acrylate, a diene, acrylonitrile, a vinyl ether, maleic acid, a maleate, maleic anhydride, cinnamic acid, or vinyl chloride with another monomer.

31. The thermal transfer recording medium according to claim 1, wherein said hot-melt ink layer further comprises 70 to 0% (v/v) of a crosslinked polymer of a vinyl monomer with a polyfunctional monomer.

32. The thermal transfer recording medium according to claim 31, wherein said polyfunctional monomer is divinylbenzene.

33. The thermal transfer recording medium according to claim 1, wherein said hot-melt ink layer further comprises a member selected from the group consisting of a polycarbonate, a polyamide, a polyester, a polyurethane, a silicone resin, a fluororesin, a phenol resin, a terpene resin, a petroleum resin, a hydrogenated petroleum resin, an alkyd resin, a ketone resin and a cellulose derivative.

34. The thermal transfer recording medium according to claim 1, wherein said hot-melt ink layer further comprises 30 to 70% (v/v) of a wax, an oil, or a liquid plasticizer based on the total amount of binder materials.

35. The thermal transfer recording medium according to claim 1, wherein said colorant is at least one member selected from the group consisting of a black dye, a black pigment, a monoazo yellow pigment comprising an acetoacetic arylamide, a bisazo yellow pigment comprising an acetoacetic arylamide, a yellow dye, a red pigment, a crimson pigment, a red dye, a blue dye, a blue pigment, a derivative of any one of the foregoing, and a modified product of any one of the foregoing.

36. The thermal transfer recording medium according to claim 1, wherein said colorant is a colored or colorless subliming dye.

37. The thermal transfer recording medium according to claim 1, wherein said release layer comprises a wax.

38. The thermal transfer recording medium according to claim 37, wherein said wax is at least one member selected from the group consisting of paraffin wax, montan wax, carnauba wax, beeswax, Japan wax, candelilla wax, a low molecular weight polyethylene, an $\alpha$-olefin oligomer, and a derivative of any one of the foregoing.

39. The thermal transfer recording medium according to claim 37, wherein said release layer further comprises a resin.

40. The thermal transfer recording medium according to claim 39, wherein said resin is a member selected from the group consisting of ethylene/vinyl acetate copolymer, ethylene/acrylic acid copolymer, polyethylene, and a petroleum resin.

41. A thermal transfer recording medium, comprising a substrate, a hot-melt ink layer, and a release layer between said substrate and said hot-melt ink layer, provided on one surface of said substrate, and a back-coated layer, provided on the other surface of said substrate, said hot-melt ink layer comprising a polyether resin having a bisphenol skeleton and hydroxyl groups at the terminal ends thereof as a binder, and a colorant, said release layer comprising a member selected from the group consisting of a silicone resin, a higher fatty acid, a metal salt of a higher fatty acid, a fatty acid derivative, a higher alcohol, and a wax, and said back-coated layer comprising a reaction product of a polyisocyanate and at least one amino-modified silicone oil.

* * * * *